United States Patent [19]

Schmeling

[11] 4,184,733

[45] Jan. 22, 1980

[54] SEGMENTED FANNING STRIP

[75] Inventor: William H. Schmeling, Wauwatosa, Wis.

[73] Assignee: Square D Company, Palatine, Ill.

[21] Appl. No.: 927,205

[22] Filed: Jul. 24, 1978

[51] Int. Cl.[2] ..... H01R 9/00

[52] U.S. Cl. ..... 339/198 H

[58] Field of Search ..... 339/198 R, 198 G, 198 GA, 339/198 H

[56] References Cited

U.S. PATENT DOCUMENTS

| | | | |
|---|---|---|---|
| 3,253,252 | 5/1966 | Piperato et al. | 339/198 P |
| 3,822,416 | 7/1974 | Haag et al. | 339/198 H |
| 3,848,951 | 11/1974 | Michaels et al. | 339/198 H |

*Primary Examiner*—Neil Abrams

*Attorney, Agent, or Firm*—M. J. Femal

[57] ABSTRACT

A snap-together segmented fanning strip that simplifies grouping of wires or spreads out the wires in a cable of a machine tool or the like for distribution to channel-mounted terminal blocks of a terminal strip to complete a series of electrical circuits. The segmented fanning strip includes a plurality of fanning blocks which incorporate a snap fit between the blocks rather than a tongue-in-groove or a keyed connection to arrange the fanning blocks in a row in a side-by-side abutting relation. To assemble the blocks in a segmented fanning strip, the top front edge of one block interfits into the channel at the top outer edge of the other block so that they are side by side and then the blocks are pressed together to snap the bottom edge of the one block into the upwardly facing channel in the bottom edge of the other block to establish the connection between the blocks. An ear projecting laterally outwardly from the bottom edge of the one block and an end wall in the channel on the top of the other block prevents rotation between blocks in a colligated state.

4 Claims, 8 Drawing Figures

FIG. 1
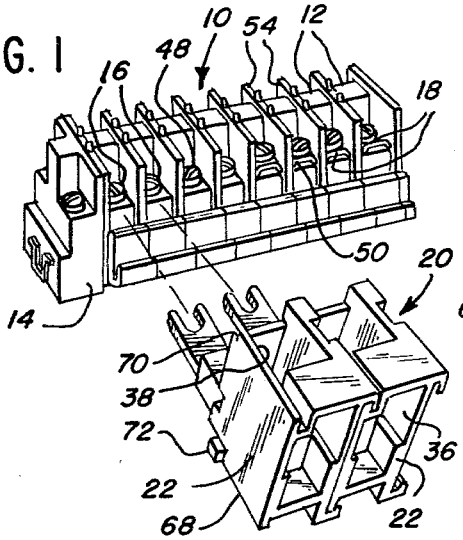
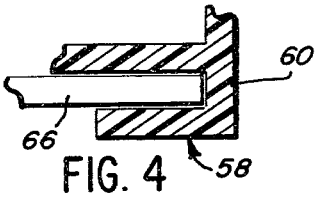
FIG. 4
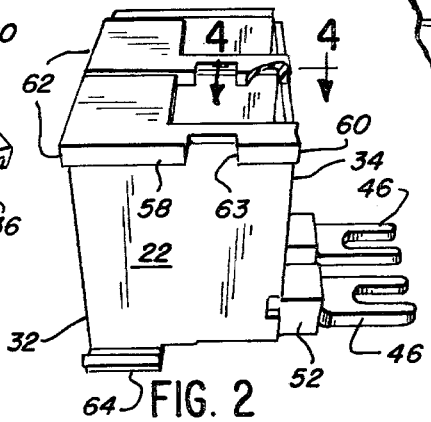
FIG. 2
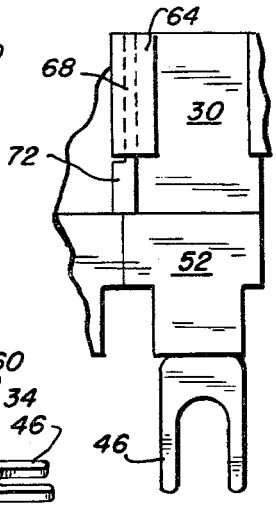
FIG. 3
FIG. 5
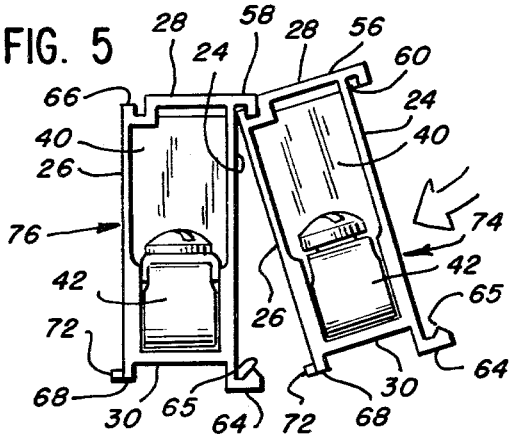
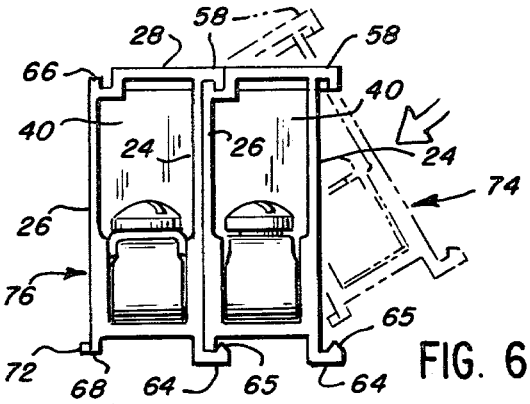
FIG. 6
FIG. 7
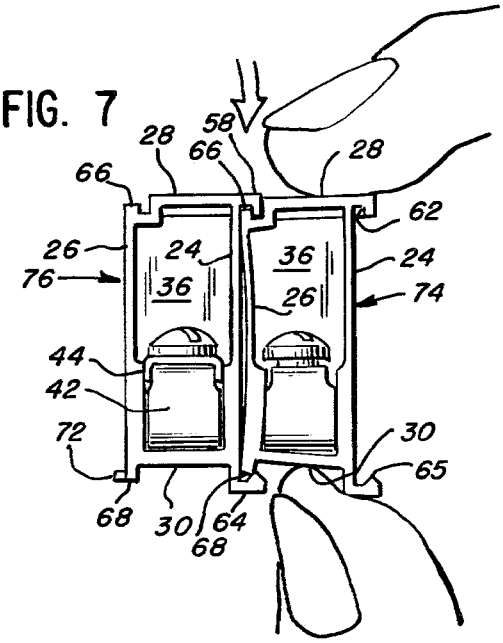
FIG. 8
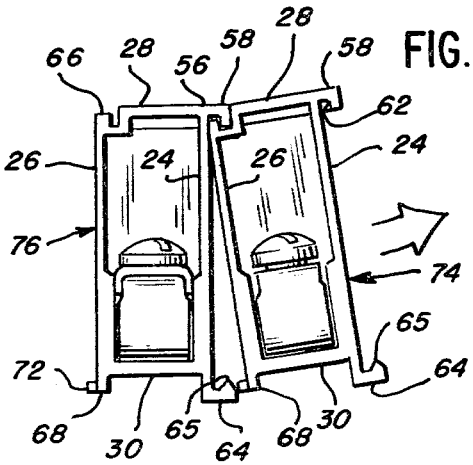

SEGMENTED FANNING STRIP

BACKGROUND OF THE INVENTION

This invention relates to a fanning strip and, more particularly, to a segmented fanning strip characterized by a snap fit between individual blocks in the fanning strip rather than a tongue-in-groove or keyed connection.

Typically, fanning strips are comprised of individual insulated blocks formed of resilient plastic materials such as a thermoplastic polyester. The blocks contain lugs for terminating electrical conductors of a cable for distribution to channel-mounted terminal blocks on a terminal strip. The interlocking arrangement between the colligated blocks in a fanning strip are often keyed or tongue-in-groove connections. Representative prior art of the keyed connection between individual blocks in a fanning strip includes U.S. Pat. No. 3,253,252, and representative prior art of the tongue-in-groove connection between individual electrical blocks includes U.S. Pat. No. 2,928,066. Representative prior art of a segmented electrical terminal strip into which the terminals of a fanning strip are terminated, includes U.S. Pat. No. 3,992,074.

However, all of the known segmented electrical fanning strips lack the efficient construction of the present invention which utilizes a snap fit between individual blocks which provide an easier method of colligating the blocks without the necessity of any tools or additional parts. The snap fit construction also prevents rotation between the individual blocks in the colligated fanning strip so that it is possible to establish a colligated electrical connector having any desired number of spaced electrical contacts corresponding to the particular terminal strip section in which the terminals of the fanning blocks are to be connected thereto.

SUMMARY OF THE INVENTION

An object of the present invention is to provide an improved segmented fanning strip to simplify grouping of wires.

Another object is to provide a segmented fanning strip which utilizes a snap fit between the individual blocks in the colligated strip to simplify assembly of the fanning strip.

A further object is to provide a segmented fanning strip in which a snap fit construction between individual blocks in the colligated strip also incorporates a locking configuration that prevents rotation between blocks to assure proper spacing between the electrical terminals of the colligated blocks and the corresponding terminal blocks of a particular section of terminal strip.

In accordance with the present invention, a segmented fanning strip includes individual blocks, each having a generally rectangular shape with parallel side walls, parallel top and bottom walls and a rear wall and an open front. An upper edge of one side wall includes a lateral extension therefrom which is integral with the top wall and forms a downwardly facing channel therewith, having a generally U-shaped cross section. The end of the channel adjacent the rear wall is closed by a wall and the other end adjacent the front of the block is open. The downwardly facing channel includes a cutout approximately intermediate its end which extends across the bottom of the channel to the one side wall. Opposite the downwardly facing channel on the bottom edge of the one side wall is an upwardly facing channel of a U-shaped cross section, parallel to the downwardly facing channel and spanning approximately one half or more of the distance from the open front side toward the rear of the block. The upper edge of the outer wall of the upwardly facing channel is slightly rounded off. The other side wall of each block includes an upper edge parallel to the bottom edge thereof and is slightly lower than the top wall and corresponds in height to the bottom of the trough formed in the downwardly facing channel on the one side wall. The top wall is joined to the other side wall in such a manner as to form a channel with the upper edge thereof. The upper edge of the other side wall also includes a right angle notch at its end adjacent the rear wall of the block which is approximately the thickness of the wall closing the end of the downwardly facing channel on the one side wall. The bottom edge on the other side wall extends downwardly below the bottom wall of the block to approximately the same depth as the trough in the upwardly facing channel on the one side wall. The bottom edge on the other side wall extends approximately the end of the upwardly facing channel on the one side wall a predetermined distance and laterally outwardly from the other side wall. The top wall is integral with the downwardly facing channel on the one side wall and extends a predetermined distance from the one side wall to the other side wall before depending downwardly a predetermined distance below the upper edge of the other wall and then extends parallel to the bottom wall into the other side wall. The top wall forms a groove with the other side wall having a J-shaped cross section so that the upper edge of the other side wall of one block fits into the downwardly facing channel on the one side wall of a second adjacent block. The bottom edge on the other side wall of the one block abuts the rounded top edge of the upwardly facing channel on the second adjacent block so that by pressing the blocks together, the bottom edge of the other side wall on the one block rides over the rounded upper edge on the upwardly facing channel on the second adjacent block and snaps into place in the trough of the upwardly facing channel. The ear on the other side wall of the one block extends over the bottom wall of the second adjacent block and abuts against the rear end of the upwardly facing channel on the one side wall of the adjacent block and the vertical side of the notch in the other side wall of the one block abuts against the end wall of the upper channel of the adjacent block so that the joined blocks are prevented from rotating with respect to one another.

BRIEF DESCRIPTION OF THE DRAWINGS

Other objects and advantages will become apparent from the following description wherein the reference is made to the accompanied drawings illustrating a preferred embodiment of the invention and in which:

FIG. 1 is a perspective view of two colligated blocks of a segmented fanning strip in accordance with this invention ready for connection to channel-mounted terminal blocks of a terminal strip;

FIG. 2 is another perspective view of two colligated blocks of the segmented fanning strip shown in FIG. 1;

FIG. 3 is a bottom view of one of the fanning strip blocks shown in FIG. 1;

FIG. 4 is a partial cross section of two fanning strip blocks joined together taken along line 4—4 of FIG. 2;

FIG. 5 is a front elevation of two fanning strip blocks as shown in FIG. 1 being assembled in the preferred fashion;

FIG. 6 is a front elevation of two fanning strip blocks as shown in FIG. 5 snap fitted together;

FIG. 7 is a front elevation of the blocks shown in FIG. 6 being disassembled;

FIG. 8 is a front elevation of the blocks shown in FIG. 7 just after separation of their bottom surfaces.

DETAILED DESCRIPTION OF THE INVENTION

A preferred embodiment of a segmented fanning strip for connection with a segmented electric terminal strip or the like in accordance with the present invention is illustrated in FIGS. 1–8.

Referring to FIG. 1, a segmented electric terminal strip 10 is generally comprised of any desired number of terminal blocks 12 mounted on a track 11 and retained thereon by a screw-on end clamp 14 at each end of the track 11. The terminal blocks 12 may have flat terminal connectors 16, pressure wire connectors 18, or box lug connectors (not shown) depending upon the termination on the particular fanning strip block to be connected thereto.

A segmented fanning strip 20 is generally comprised of a plurality of individual fanning strip blocks 22 incorporating a snap fit between blocks 22 to assemble the blocks in a row in a side-by-side abutting relationship. Each fanning strip block 20 is formed of a molded renitent synthetic material, such as a thermoplastic polyester. A renitent synthetic material will resist deformation and yet provide sufficient resiliency to permit portions thereof to be flexed without fracturing and without requiring an excessively high snap fit assembling force. Each fanning strip block 22 of the insulated material comprises a pair of opposed side walls 24 and 26, a top wall 28, a bottom wall 30 and opposite front and rear ends 32 and 34, respectively. A recess 36 extends vertically from the bottom wall 30 upwardly to an opening 38 in the top wall 28. The side walls 24 and 26, and a rear wall 40 of the rear end 34 close off the three vertical sides of the recess with the front end 32 completely open to recess 36.

The recess 36 houses an electrical contact, such as a lug 42 having a pressure wire clamp 44, a binding screw 45 and a forked terminal 46. The forked terminal 46 passes through an opening in the rear wall 40 of the block 22 to project beyond the block. The forked terminal 46 is placed under the head of a binding screw 48 of the flat terminal connector 16 or under the U-shaped clamp 50 of the pressure wire connector 18.

Extending a predetermined distance perpendicular to rear wall 40 and integral therewith is a nose like projection 52 of the same thermoplastic polyester encompassing a portion of the terminal 46. The nose like projection 52 extends past insulated walls 54 of the terminal blocks 12 to totally isolate the forked terminals 46 of adjacent fanning blocks 22 from one another.

Each block 22 is generally a rectangular shape and the parallel side walls 24 and 26, respectively, include various channels, grooves, and other projections (to be described in greater detail later) which permit one block to interfit with another block and thereby be pressed together in a snap fit relationship. An upper edge 56 of the one sidewall 24 includes a lateral extension therefrom which is intergral with the top wall 28 and forms a downwardly facing channel 58 therewith, having a generally U-shaped cross section. The end of the channel adjacent the rear wall 40 is closed by a wall 60 and the other end adjacent the front end 32 of the block is an opening 62. The channel 58 further includes a cutout 63 approximately intermediate its ends which extends from the outside wall of the channel 58 across the bottom of the channel to the one side wall 24. Opposite the downwardly facing channel 58 on the bottom edge of the one sidewall 24 is an upwardly facing channel 64 of a U-shaped cross section, parallel to the downwardly facing channel 58. Channel 64 spans approximately one-half or more of the distance from the open front side 32 toward the rear end 34 of the block 22. An upper edge 65 of the outer wall of the upwardly facing channel 64 is slightly rounded off. Channel 64 depends below the bottom wall 30.

The other side wall 26 of each block 22 includes an upper edge 66 parallel to a bottom most edge 68 thereof and is slightly lower than the top wall 28 to correspond in height to the bottom of the trough formed in the downwardly facing channel 58 on the one side wall 24. The top wall 28 which is integral with the downwardly facing channel 58 on the one side wall 24 extends a predetermined distance from the one side wall 24 toward the other side wall 26 before depending downwardly a predetermined distance below the upper edge 66 of the other side wall 26 and then extends parallel to the bottom wall 30 into the other side wall 26. Therefore, the top wall 28 forms a groove with the other side wall 26 which has a J-shaped cross section so that the upper edge 66 of the other side wall 26 of one block fits into the trough of the downwardly facing channel 58 on the one side wall 24 of a second adjacent block. The upper edge 66 of the other side wall 26 also includes a right angle notch 70 at its end adjacent the rear wall 40 of the block 22. The width of the right angle notch 70 is approximately the thickness of the end wall 60 of channel 58.

The bottommost edge 68 of the other side wall 26 extends downwardly below the bottom wall 30 of the block 22 to approximately the same depth as the trough in the upwardly facing channel 64 on the one side wall 24. The bottommost edge 68 on the other side wall 26 extends approximately from the front end 32 of the block 22 to the rear end of the upwardly facing channel 64 on the one side wall 24 before terminating in an ear 72 which extends laterally outwardly from the other side wall 26.

To assemble the fanning strip blocks 22 in a colligated fashion, the upper edge 66 of the other wall 26 of one block 22 is inserted into the trough of the downwardly facing channel 58 which insertion can be viewed through the cutout 63 in channel 58. The one block is positioned so that the vertical side of the right angle notch 70 abuts against the inside of the rear end wall 60 which automatically provides a front to rear positioning between the blocks 22 to be colligated. Next, the one block 74 is pivoted so that the bottom edge of the other wall 26 engages the rounded off edge 65 on channel 64 on the one side wall 24 of adjacent block 76 so that by pressing blocks 74 and 76 together, the bottom edge 68 of the other side wall 26 on the block 74 rides over the rounded upper edge 65 on the upwardly facing channel 64 on the adjacent block 76 and snaps into place in the trough of th upwardly facing channel 64 as shown in FIGS. 5 and 6. As shown further in FIG. 3, the ear 72 on the other side wall 26 of the one block 74 extends over the bottom wall 30 of the adjacent block 76 and abuts against the rear end of the upwardly facing channel 64 on the one side wall 24 of the adjacent block 76. The vertical side of the notch 70 in the other side wall 26 of the one block 74 abuts against the end wall 60 of the upper channel 58 of the adjacent block 76 so that the colligated blocks are prevented from rotating with respect to one another once colligated.

To disassemble colligated blocks 22 as shown in FIGS. 7 and 8, pressure is applied to the top and bottom walls 28 and 30, respectively, so that the bottom edge 68 of the one block 74 is able to flex the channel 64 downwardly as the edge rides over rounded off upper edge 65 of channel 64 and then the upper edge 66 of the one block 74 is removed downwardly and out of the trough formed by a downwardly facing channel 58 on the adjacent block 76.

I claim:

1. A colligated segmented electrical fanning strip for grouping a series of electrical conductors in a preselected sequence to detachably connect the electrical conductors to a segmented terminal strip having a corresponding series of spaced terminal members electrically insulated from one another, the improvement comprising:

a plurality of contiguous blocks of insulating material, each block having opposite parallel sidewalls, opposite parallel ends and opposite top and bottom walls;

an electrical contact secured within each block to establish a group of spaced apart electrical contacts electrically insulated from one another and corresponding to a group of electrical conductors and spaced terminal members, each contact having a means for receiving electrical conductors adjacent to one end of the block and terminal projecting beyond the opposite end of the block in a direction normal thereto;

a pair of U-shaped channels projecting from the top and bottom edges of one sidewall of each block and extending from the one end toward the opposite end a predetermined distance parallel to the one sidewall with their openings facing one another;

a J-shaped channel defined by the upper edge of the other sidewall and the top wall of each block extending along a direction parallel to the opposite sidewall, the lower vertical side of said J-shaped channel forming the upper edge of the other sidewall of each block, the upper edge of the other sidewall being in the same plane as the inner bottom wall of the upper channel on the one sidewall of each block so that the lower vertical side of the J-shaped channel of one block interfits into the recess of the upper channel on an adjacent block; and a bottommost edge on the other sidewall of each block extending below the bottom wall of each block a predetermined distance and extending from the one end toward the opposite end parallel to the upper edge of the other sidewall before terminating in a laterally extending ear so that the blocks are assembled into a colligated segmented electrical fanning strip by having the J-shaped channel of one block interfit into the upper channel on the one sidewall of an adjacent block to place the one block and the adjacent block in a side-by-side relationship which permits the blocks to be pressed together to snap the bottommost edge of the other sidewall of the one block into the recess of the upwardly facing channel on the bottom edge of the adjacent block to establish a non-rotatable and non-moveable connection between the blocks in a colligated state.

2. The segmented electrical fanning strip of claim 1 wherein the upper channel on the sidewall of each block includes an end wall flush with the opposite end of each block and the other sidewall of each block includes a right angle notch at the upper corner adjacent the opposite end of each block on the lower vertical side of the J-shaped channel forming the upper edge of the other sidewall so that the vertical side of the notch abuts against the inside of the end wall on the upper channel on the one sidewall of assembled blocks to prevent lateral or rotational movement between colligated blocks.

3. The segmented electrial fanning strip of claim 1 wherein the ear of each block overlaps the bottom wall of one adjacent colligated block.

4. The electrical segmented fanning strip of claim 1 wherein the blocks are molded from a renitent synthetic material such as a thermoplastic polyester so that the bottom channel on the sidewall flexes downwardly to permit the lower edge of the other sidewall to ride over the outer edge of the bottom channel without fracturing and without requiring an excessively high snapfit assembling force.

* * * * *